US012018923B2

(12) United States Patent
Stubbs et al.

(10) Patent No.: US 12,018,923 B2
(45) Date of Patent: Jun. 25, 2024

(54) LIGHTWEIGHT AMMUNITION BELT LINK

(71) Applicant: BAE SYSTEMS plc, London (GB)

(72) Inventors: Joshua Matthew Stubbs, Crewe (GB); Nathan William Rowe, Crewe (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/005,412

(22) PCT Filed: Jul. 9, 2021

(86) PCT No.: PCT/GB2021/051757
§ 371 (c)(1),
(2) Date: Jan. 13, 2023

(87) PCT Pub. No.: WO2022/013528
PCT Pub. Date: Jan. 20, 2022

(65) Prior Publication Data

US 2023/0266108 A1 Aug. 24, 2023

(30) Foreign Application Priority Data

Jul. 16, 2020 (EP) ..... 20275119
Jul. 16, 2020 (GB) ..... 2010964

(51) Int. Cl.
*F42B 39/08* (2006.01)

(52) U.S. Cl.
CPC ..... *F42B 39/08* (2013.01)

(58) Field of Classification Search
CPC ..... F42B 39/08
USPC ..... 89/35.02
See application file for complete search history.

(56) References Cited

U.S. PATENT DOCUMENTS

| | | | | |
|---|---|---|---|---|
| 891,374 A | | 6/1908 | Ruszitszka | |
| 1,376,354 A | | 4/1921 | Peoples | |
| 2,022,685 A | | 12/1935 | Moore | |
| 2,163,725 A | | 6/1939 | Bergmann | |
| 2,453,540 A | | 10/1942 | Reid | |
| 2,426,527 A | | 6/1944 | Sanford et al. | |
| 2,376,962 A | | 5/1945 | French et al. | |
| 2,472,817 A | * | 6/1949 | Gaidos | F42B 39/08 89/35.02 |
| 2,856,819 A | | 10/1958 | Meyers et al. | |

(Continued)

FOREIGN PATENT DOCUMENTS

| | | | | |
|---|---|---|---|---|
| FR | 755845 A | * | 11/1933 | F42B 39/08 |
| GB | 0141129 A | | 4/1920 | |

(Continued)

OTHER PUBLICATIONS

International Search Report and Written Opinion received for PCT/GB2021/051757. Mailed: Oct. 1, 2021. 12 pages.

(Continued)

*Primary Examiner* — Jonathan C Weber
(74) *Attorney, Agent, or Firm* — Finch & Maloney PLLC

(57) ABSTRACT

There is provided an ammunition belt link comprising, a sprung wire, said sprung wire arranged to form a first receiving portion suitable for retaining a first ammunition cartridge, a second receiving portion suitable for retaining a second ammunition cartridge, a spacer between said first receiving and second receiving portions; and an ammunition cartridge locator aide, said aide locates in an ejector groove of a received cartridge.

20 Claims, 5 Drawing Sheets

(56) References Cited

U.S. PATENT DOCUMENTS

Figure 1A:
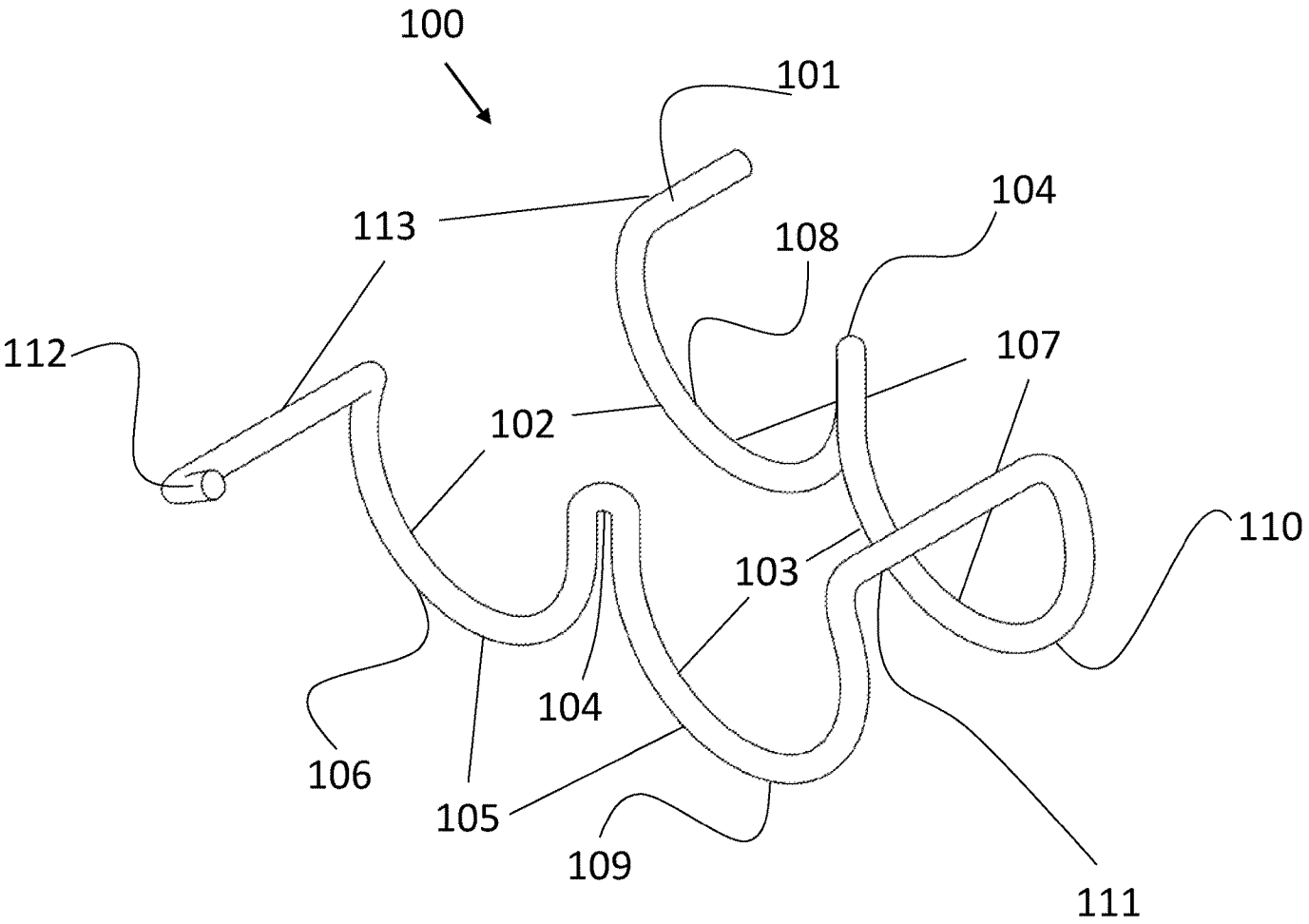

| | | | |
|---|---|---|---|
| 3,650,176 | A | 3/1972 | Lindner |
| 2012/0144712 | A1 | 6/2012 | Rostocil |
| 2014/0069290 | A1 | 3/2014 | Padgett et al. |
| 2016/0202032 | A1 | 7/2016 | Kokinis et al. |
| 2023/0258441 | A1 | 8/2023 | Stubbs et al. |

FOREIGN PATENT DOCUMENTS

| | | | | | |
|---|---|---|---|---|---|
| GB | 813627 | A | * | 5/1959 | ..... F42B 39/08 |
| GB | 892831 | A | | 3/1962 | |
| WO | 2022013530 | A1 | | 1/2022 | |
| WO | WO 2022013528 | A1 | | 1/2022 | |

OTHER PUBLICATIONS

GB Search Report under Section 17(5) received for GB Application No. 2010964.1, dated Oct. 22, 2020. 3 pages.
Extended European Search Report received for EP Application No. 20275119.4, dated Jan. 12, 2021. 6 pages.
International Search Report and Written Opinion received for PCT/GB2021/051759. Mailed: Oct. 8, 2021. 10 pages.
GB Search Report under Section 17(5) received for GB Application No. 2010963.3, dated Oct. 14, 2020. 3 pages.
Extended European Search Report received for EP Application No. 20275118.6, dated Jan. 12, 2021. 7 pages.

* cited by examiner

LIGHTWEIGHT AMMUNITION BELT LINK

The present invention relates generally to a lightweight wire ammunition belt link and a related method of manufacture of said link.

Ammunition belt links are used to hold ammunition cartridges for belt fed weapon systems in order to allow continuous rapid firing of said weapon systems without the need to reload a magazine. The first belt links were typically made of canvas strips however these were prone to contamination by water and oils which contract the fabric and prevent rounds being extracted by the bolt mechanism of the firearms.

Modern day belt links are disintegrating links which are typically pressed from a flat sheet of metal to form a double circular channel designed to retain two cartridges. The individual belt links are able to 'hook' on the next cartridge, said cartridge retained by another link in order to form a continuous chain of ammunition at the desired length of the user. As the cartridge is extracted and expended from the link by the bolt mechanism of the weapon system, the individual link separates from the chain and is ejected from the feed mechanism. Non disintegrating metallic feed strips can also be used to hold ammunition cartridges however these are limited by round capacity and can generally hold only 24-30 rounds per strip.

It will be appreciated by the skilled person that such belt links add weight to an ammunition system which may have consequences, for example, airborne systems in terms of range and endurance or indeed man portable weapons where ammunition weight makes up a substantial proportion of a soldier's carrying weight. It will be therefore be further appreciated that any reduction in weight of said ammunition systems is beneficial.

It is an example aim of the present invention to at least partially solve or avoid one or more problems or disadvantages with disintegrating plate belt links, whether identified herein or elsewhere, namely that of reducing weight in ammunition belt links.

According to a first aspect of the present invention, there is provided a wire ammunition belt link comprising, a sprung wire, said sprung wire arranged to form, a first receiving portion suitable for retaining a first ammunition cartridge, a second receiving portion suitable for retaining a second ammunition cartridge and, a spacer between said first receiving and second receiving portions and an ammunition cartridge locator aide, said aide locates in an ejector groove of a received cartridge.

The sprung wire of the ammunition belt link may be made of metal, metal alloys, polymers or composites. In a preferred arrangement, a material with a material hardness in the range of from 390-470 HV and Youngs Modulus in the range of 1000 to 1500 MPa, preferably 1112 MPa may be used, thereby providing materials which may return to their original shape when subject to large deflections or twisting. Preferably, the sprung wire of the wire ammunition belt link is made from metal. The metals may be selected from steels, shape memory alloys, titanium. More preferably, the sprung wire is made from sprung mild steel, such as, for example carbon steel DIN 1544-C45N DIN 17200.

The sprung wire may be of any suitable cross section shape, highly preferably the sprung wire is circular. The sprung wire may be of any suitable diameter (gauge), which allows proper engagement with a feed mechanism of a weapon system so as to avoid fouling the feed mechanism or weapon chamber. The selection of the diameter of the sprung wire may be determined with reference to the manufacturer's guidelines of the relevant weapon system to which the ammunition belt link is to be used. It was found for a 7.62 mm system, preferably the diameter of the sprung wire is in the range from 0.25-2 mmmm, more preferably in the range from 0.5-0.8 mm. It would be clear that the diameter will be selected depending on the weapons system used, the same as for disintegrating plate belt links.

In a further arrangement, the sprung wire, may be reduced in diameter at selected points, to reduce the dimension of the sprung wire.

The present inventors have realised that use of a sprung wire can yield weight reductions in the range of 60% over traditional disintegrating plate belt links. For example, a traditional disintegrating plate belt link for a 7.62 mm cartridge weighs 4 g whereas a wire ammunition belt link made from 1.25 mm mild steel sprung wire weighs 1.379 g.

The sprung wire may be coated by a protective layer; such as to prevent oxidisation or to increase friction. Protective layers may be selected from any commonly used materials to protect metals, such as, for example, polymers, phosphates, paints, lacquers, metal plating.

The sprung wire may be made of a plurality of individual wire pieces joined together to form the individual ammunition belt link or may be made from a unitary piece of sprung wire. In a highly preferred arrangement, the ammunition belt link contains only a unitary piece of sprung wire formed into said belt link; the unitary piece of sprung wire is a continuous length of sprung wire.

Preferably the sprung wire links are disintegrating links.

The first and second receiving portion may retain the first and second ammunition cartridges, respectively, by way of a 'push fit' interference engagement such that there is interference between the cartridge and the first and second receiving portions of the belt link.

In a preferred arrangement the first and second receiving portions may be a 'push fit' interference engagement and the minimum cross sectional distance of the first and second receiving portions may be in the range of from 1% to 6% smaller than the diameter of the received ammunition cartridge. Preferably the minimum cross sectional distance is in the range of from 4% to 5% smaller than the received ammunition cartridge. The ammunition cartridges are manufactured to tight tolerances typically to a standard, such as for example NATO standard. This allows any calibre, ie 5.56 mm, intermediate, 7.62 mm or even higher calibre bullets to be fired from multiple weapon platforms.

The projectile and cartridge case dimensions, diameter, length are readily available. Further, the force required by the ejection mechanism on the weapon, to eject the ammunition cartridge from the link is known.

The first and second receiving portions may extend at least 180 degrees around the circumference of the ammunition cartridge, more preferably, the receiving portions may be re-entrant in shape, greater than 180 degrees, in order for the ammunition cartridge to be suitably retained. The first and second receiving portions may extend around the ammunition cartridge in the range from 180 to 320 degrees. Preferably, the first and second receiving portion extend in the range from 296 to 280 degrees around the ammunition cartridge.

The first and second receiving portions may, in cross section, be polygonal such as square, pentagonal, hexagonal, octagonal or higher sided shape or any combination thereof or circular, such that allows the ammunition cartridge to be retained. It will however be appreciated in a shape other than circular, the faces of the shape must contact with the ammunition cartridge in order for it to be retained by friction. In a highly preferable arrangement, the first and second receiving portion are circular in nature to provide the greatest contact area of the sprung wire with the ammunition cartridge case.

The first and second receiving portions may be independently selected from different cross section shapes, for example, the first receiving portion may be circular and the second receiving portion octagonal. In a preferable arrangement, the first and second receiving portions are selected as the same cross section shape.

The spacer between the first and second receiving portions provides the required separation between the two ammunition cartridges. Particularly, the spacer provides a separation gap between the centre points of the first ammunition cartridge and second ammunition cartridge, when fitted within the ammunition belt link. The separation gap ensures that the ammunition can engage with a belt fed ammunition system. If the separation gap between the centre points of the first and second ammunition cartridge are too close together or are too far apart, the weapon feed system will not function correctly. The separation gap provided by the spacer is known and is defined according to the manufacturer's guidelines of the relevant weapon system.

The spacer may be made of the same or of a different material from that of the first and second retaining portions. For example, the spacer may be a polymer clip or a sprung wire. The sprung wire may be different piece of sprung wire to that of the first and second receiving portions sprung wire, however in a highly preferable arrangement, the spacer, the first and second retaining portions i.e. entire belt link may be formed from a unitary piece of wire.

The spacer may take the form of different geometries, so as to provide different separation gaps. For example when made from a sprung wire, the spacer may be a simple re-entrant bend. Alternatively the spacer may be a loop or coil of wire rotating about at least 360 degrees. The thickness of the spacer, will be selected to provide the required separation gap between the ammunition within the belt link.

The sprung wire may comprise a flange, said flange may be positioned length ways along the axial length of the ammunition cartridge. The flange may extend outwardly from the first and/or second receiving portions, to provide increased grip with the ammunition cartridge, by increase the contact area of the belt link, and improve retention of the ammunition cartridge. In a preferable arrangement, there are two flanges formed from the sprung wire. In a further preferable arrangement, the flanges, first and second receiving portions and respective spacers are made from a unitary piece of wire.

The wire ammunition belt link comprises an ammunition cartridge locator aide, said cartridge locator aid at a first end extends from the belt link, and the second distil end in use locates in the ejector groove of a received ammunition cartridge. The locator aid may have a length selected to cause the wire ammunition belt link to be accurately and repeatedly located on the ammunition cartridge such that when joined in a link, the cartridges are all in alignment. Said locator aide may cause the ammunition cartridges, when fitted within the wire ammunition belt link, to be correctly orientated in the same direction. Said locator aide further ensures that the ammunition belt link and subsequent adjacent wire belt links are in the correct position in order to be ejected from a weapon system. The locator aide may be formed from a unitary piece of wire. In a preferable arrangement, the ammunition cartridge locator aide may be and extension from one of the flanges.

The wire ammunition belt link may be of a 'push through' cartridge feed design. In this design configuration, a received cartridge is pushed forwards through the ammunition belt link into the barrel of the weapon by a bolt. In such designs, it is necessary that the first and second receiving portions comprise an opening, a non-closed loop, such as for example a re-entrant or half-open portion, in order to allow the bolt mechanism of the weapon system to function correctly. E.g. the sprung wire extends around the ammunition cartridge at a value less than 360°. In a 'push through' design, it is expressly not permissible to allow the sprung wire to extend around the complete circumference of the received ammunition cartridge as such designs will foul the feed mechanism of the weapon system.

There may be provided an offset between the first and second receiving portions such that the difference in offset allows the second receiving portion to 'hook' onto the next ammunition cartridge in between or outside of the first receiving portion of a second wire ammunition belt link when linked as a belt. The difference in offsets may be in the range of 1 to 5 mm. preferably, the difference in offset is in the range of 1 to 2 mm although it will be appreciated that the difference in offset must be at least the cross sectional diameter of the sprung wire to avoid overlapping with an adjacent link. It will further be appreciated that the maximum offset is limited by the length of the ammunition cartridge body and/or the weapon feed mechanism Said 'hooking' action of the second receiving portion is enough to retain the second ammunition cartridge whilst allowing rotational movement about the axis of the ammunition cartridge in order to allow the first wire ammunition belt link to rotate with respect to the second wire ammunition belt link.

The arrangement of multiple belt links as defined herein, may have offsets selected such that the first receiving portions on one link, abuts the second receiving portion.

The wire ammunition belt link may have further receiving portions, for example, a third receiving portion, a fourth receiving portion etc. but this may reduce flexibility of the ammunition when linked together, as there is reduced articulation of the wire ammunition belt link as a whole.

The first and second receiving portion may be provided by a plurality of wire arms. Said first and second receiving portions may comprise a first arm and a second arm. The first arm may comprise a first partial receiving portion for the first ammunition cartridge and a second partial receiving portion for the second ammunition cartridge. The second arm may comprise a first partial receiving portion for the first ammunition cartridge and a second partial receiving portion for the second ammunition cartridge.

The first and second wire arms of the ammunition belt link may be made of metal, metal alloys, polymers or composites. In a preferred arrangement, the first and second wire arms are made from a sprung wire as herein described before, more preferably, the sprung wire is made from sprung mild steel.

The first and second wire arms may be joined by a linkage. The linkage may be made of the same or of a different material to that of the first and second wire arm. For example, the linkage may be a plastic clip or a sprung wire. In a highly preferable arrangement, there is one linkage joining the first and second wire arms made from the same sprung wire as the first and second wire arm such that they are formed from a unitary piece of wire.

In another arrangement, there may be a plurality of linkages joining the first and second arms of the first and second receiving portions distributed along the length of the first and second arms for enhanced rigidity.

The first and second partial receiving portions of the first and second wire arms may be joined by a spacer as described herein before. In a preferable arrangement, the spacer is made from a re-entrant loop or coil of wire. In a further preferable arrangement, the spacer is made from the same piece of unitary wire as that of the first and second arm such that it is a unitary length of wire.

The first and second wire arms of the first and second receiving portions may be offset from each other axially along the cartridge. The axial offset ensures the angular alignment of adjacent ammunition cartridges with respect to each other, such that they are parallel. The minimum axial offset between the first arm and second arm of the first and second receiving portions may be in the range of from 10 to 27 mm. Preferably, the offset is in the range of from 12 to 14 mm.

The offset between the partial sections of the first arm and second wire arm that together form the first receiving portion may be greater than or smaller than the offset between the partial sections of the first wire arm and second wire arm that together form the second receiving portion. The difference in offset allows the partial sections of the first and second arms that form the second receiving portion to 'hook' on to the next ammunition cartridge in between or outside of the partial sections of the first and second arms that together form the first receiving portion of a second wire ammunition belt link when linked as a belt.

The difference in offsets may be in the range of 1 to 5 mm. preferably, the difference in offset is 1 to 2 mm although it will be appreciated that the difference in offset must be greater than the 2× the cross sectional diameter, i.e. each arm must of the sprung wire must offset greater than the diameter of the sprung wire in order to avoid a clash with an adjacent link. It will further be appreciated that the maximum offset is limited by the length of the ammunition cartridge body and/or the weapon feed mechanism. Said 'hooking' action of the second receiving portion is enough to retain the second ammunition cartridge whilst allowing rotational movement about the axis of the ammunition cartridge in order to allow the first wire ammunition belt link to rotate with respect to the second wire ammunition belt link.

There may be provided further wire arms, such as, for example a third arm, fourth arm, and fifth arm etc. It will be appreciated that subsequent wire arms will in turn form subsequent partial receiving portions, for example, a third, fourth and fifth receiving portion respectively.

According to a second aspect, there is provided a method of manufacturing a wire ammunition belt link, the method comprising, bending a continuous length of sprung wire by a wire forming machine to create a wire ammunition belt link. Such machines are well known in the art and may include manual wire forming machines or CNC wire forming machines.

In an alternative manufacturing method, the sprung wire may be manufactured by bonding or fusing a plurality of pre-sprung wire formed sections to create the wire ammunition belt link. In another alternative method, the sprung wire may be forged in a near final shape before being rolled to the required final shape.

The method may comprise manufacturing a plurality of wire ammunition belt links from a continuous length of sprung wire before being cut to form individual wire ammunition belt links. For example, a sprue of 5, 10, 15 or 20 links to support mass production techniques.

The method may further comprise coating the sprung wire with a protective layer. Said layer may be deposited by a number of known techniques such as wire extrusion, electrodeposition and painting.

In a highly preferable method, the wire ammunition belt link is formed by a wire forming machine from a continuous length of sprung wire to form at least two arms, spacer and linkage.

According to a third aspect of the present invention there is provided a wire ammunition belt suitable for a belt fed ammunition system, the wire ammunition belt comprising, a first wire ammunition belt link and a second wire ammunition belt link, as defined herein before, wherein a first ammunition cartridge is located in the first receiving portion and a second ammunition cartridge is located in the second receiving portion of the first wire ammunition belt link, and the second ammunition cartridge is further located in a first receiving portion of the second wire ammunition belt link to create the continuous wire ammunition belt.

The co-location of the second ammunition cartridge within both the second receiving portion of the first wire ammunition belt link and the first receiving portion of the second wire ammunition belt link allows the second wire ammunition belt link to rotate with respect to the first wire ammunition belt link about the second ammunition cartridge. In a preferred arrangement the second receiving portion comprises the locator aid extending therefrom, said locator aid preventing axial movement along the cartridge case, and highly preferably the end of the locator aid prevents rotation of the second receiving portion about said case. Preferably, rotation about the first receiving portion is permitted.

Figure 1B:
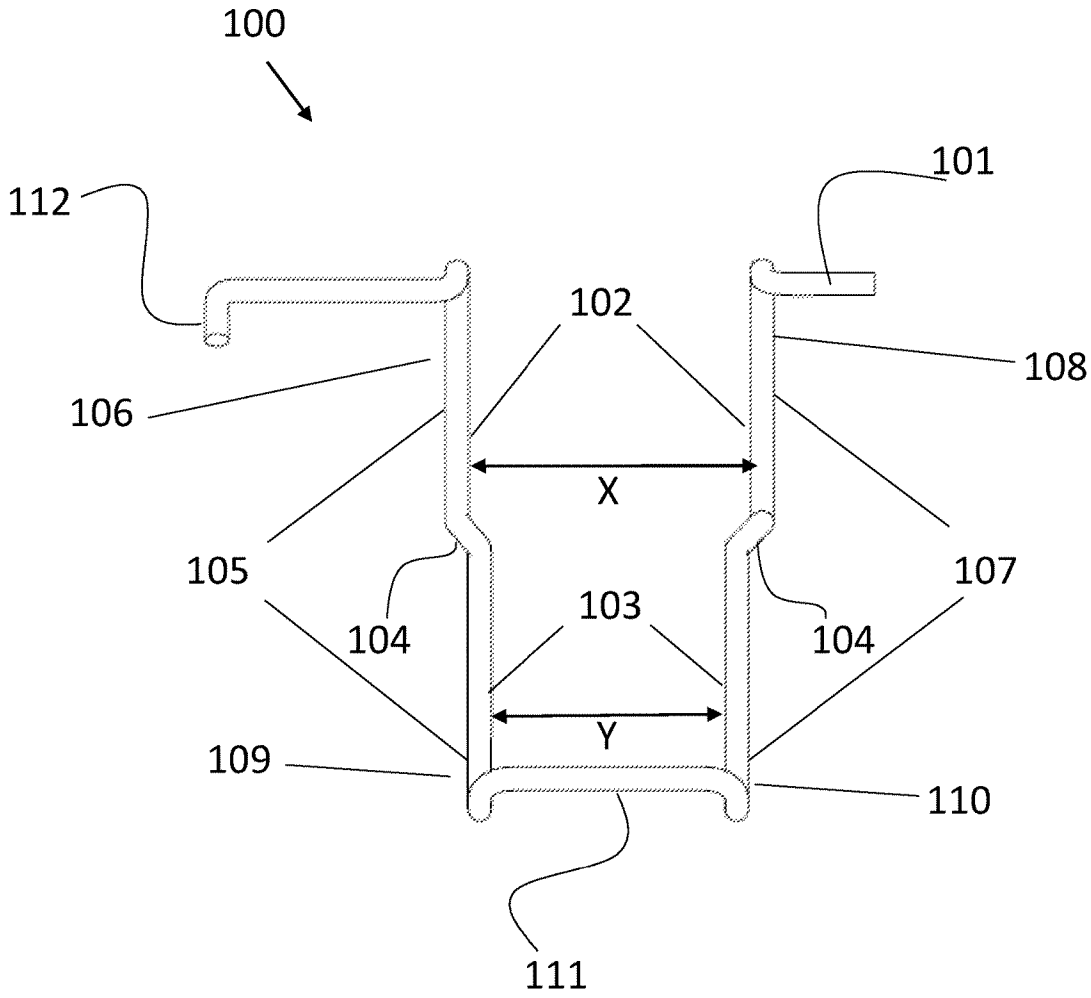

Several arrangements of the invention will now be described by way of example and with reference to the accompanying drawings of which;

FIGS. 1*a* and 1*b* show a wire ammunition belt link.

Figure 2:
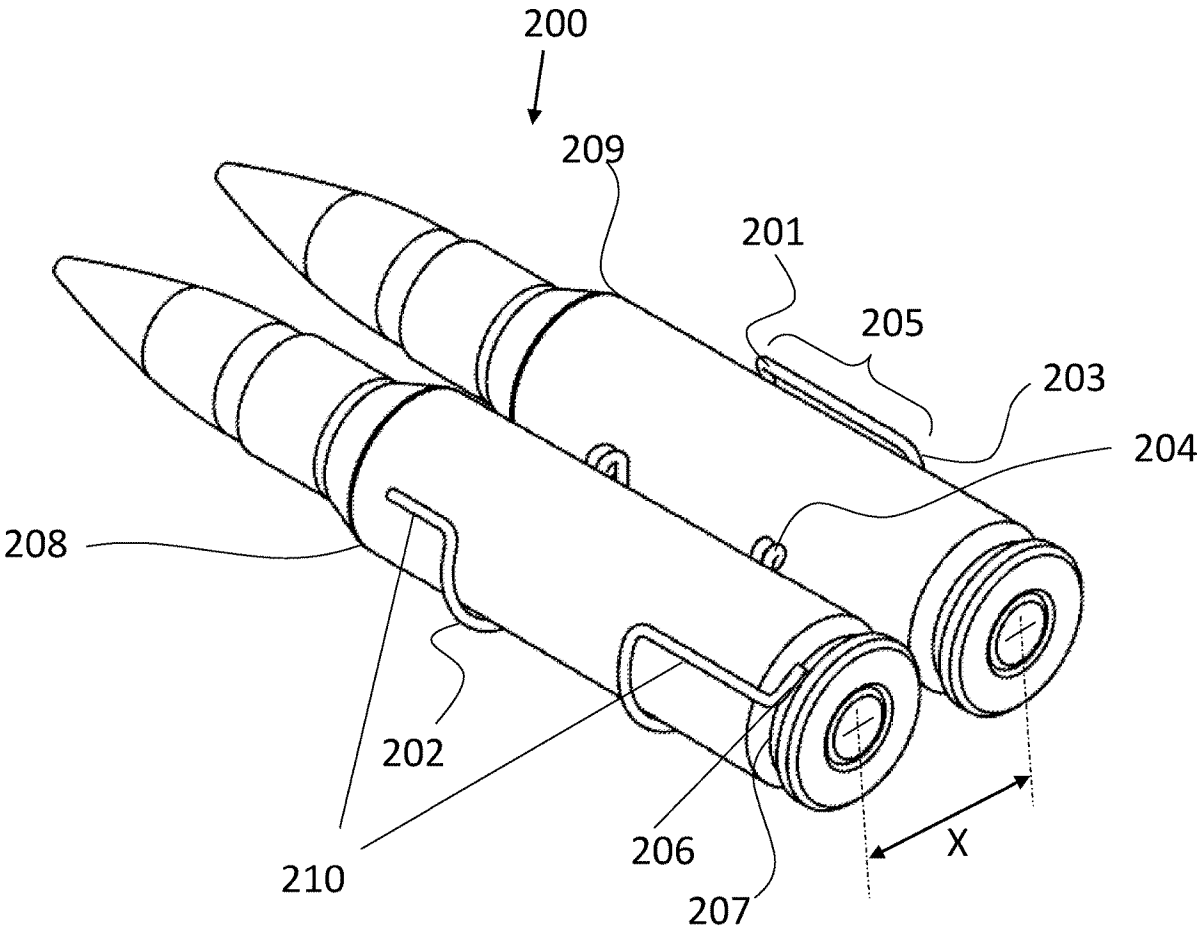

FIG. 2 shows an alternative arrangement with ammunition cartridges loaded therein.

Figure 3A:
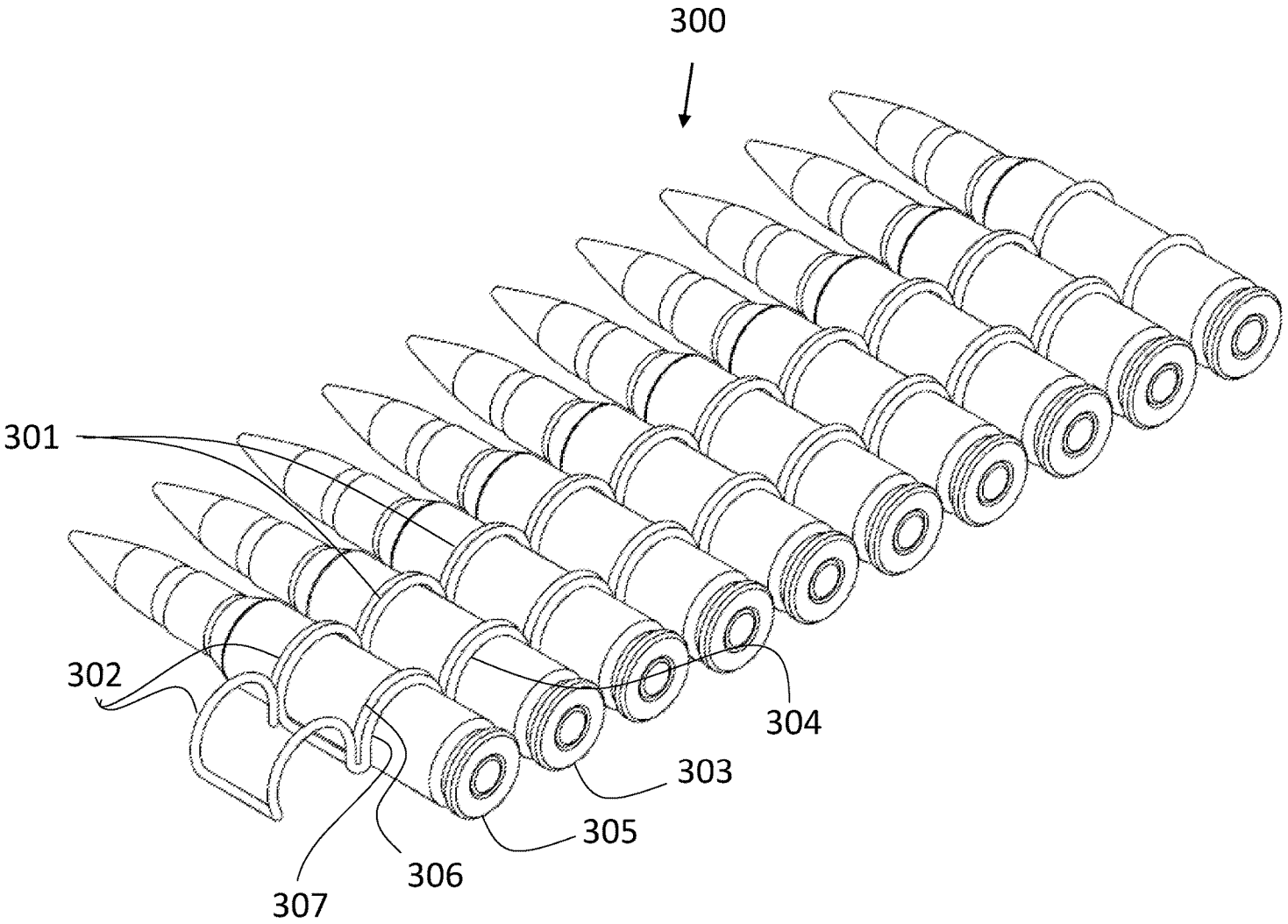
Figure 3B:
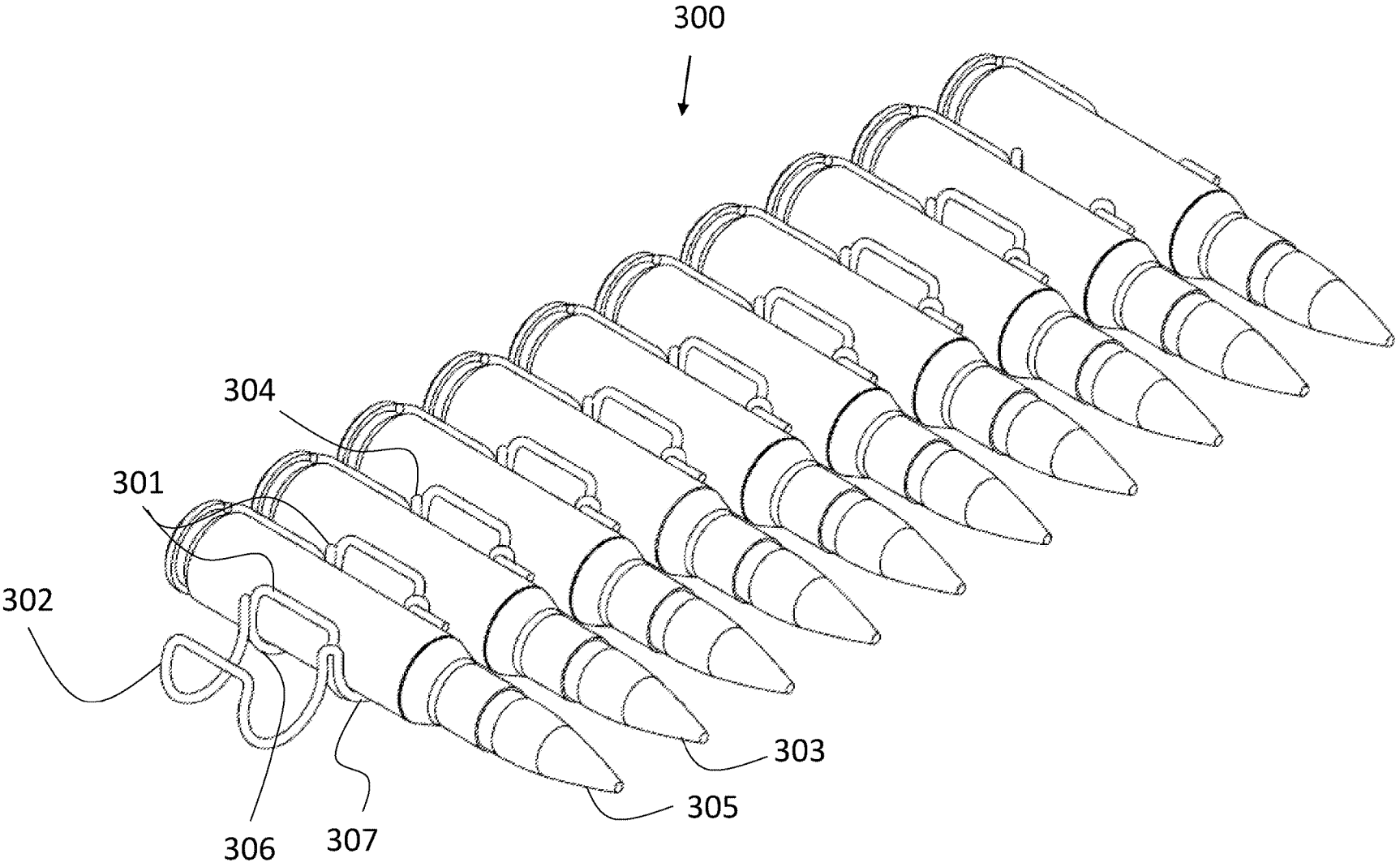

FIGS. 3*a* & 3*b* show a wire ammunition belt loaded with ammunition cartridges.

Turning to FIG. 1*a*, there is provided a wire ammunition belt link 100 comprising, a sprung wire 101, said sprung wire arranged to form, a first receiving portion 102 suitable for retaining a first ammunition cartridge (not shown), a second receiving portion 103 suitable for retaining a second ammunition cartridge (not shown) and, a spacer 104 between said first receiving and second receiving portions.

In the present arrangement, the sprung wire 101 is made from a unitary i.e. continuous piece, of sprung wire formed into said belt link. The sprung wire is made from 0.8 mm diameter mild steel.

The first and second receiving portions (102, 103) retain the first and second ammunition cartridge (not shown—see FIG. 2) by way of a 'push fit' engagement such that there is interference between the ammunition cartridge and the belt link. In the present arrangement, the first and second receiving portions (102, 103) are circular in nature with a re-entrant curvature around the ammunition cartridge.

In the present arrangement, the first receiving portion 102 comprises, a first arm 105, said first arm comprising a first partial receiving portion 106 for the 20 first ammunition cartridge and a second arm 107 comprising a first partial receiving portion 108 for the first ammunition cartridge.

The second receiving 103 portion comprises, the first arm 105, said first arm comprising a second partial receiving portion 109 for the second ammunition cartridge and a second arm 107, comprising a second partial receiving portion 110 for the second ammunition cartridge.

The first arm and second arm of the first and second receiving portions are joined by a linkage 111 at the ends of the first and second arms such that it is a continuous unitary sprung wire, said linkage made of the same material of the first and second arm.

The provision of a spacer 104 allows separation between the centre points of the first ammunition cartridge and second ammunition cartridge, when fitted within the ammunition belt link, to allow engagement with a belt fed ammunition system. In the present arrangement, the spacer 104 is formed from the same unitary piece of wire as that of the first retaining portion 102, second retaining portion 103 and the link 111. The spacer 104 may be any shape, in this arrangement a single re-entrant bend/loop which provides spacing between the centre points of the neighbouring ammunition cartridge when loaded into the wire ammunition belt link.

In the present arrangement, there is provided two flanges 113. Said flanges are positioned length ways along the axial length of the ammunition cartridge located at the distil ends of the first and second arms. In the present arrangement, one of the flanges is an ammunition cartridge locator aide 112, said aid locates in the ejector groove of a received ammunition cartridge to enable the wire ammunition belt link to be accurately located axially along the ammunition cartridge such that when joined in a belt i.e. when joined as a plurality of belt links, the cartridges align at their headstamps.

Two ammunition cartridges may be linked by just one arm 105, with first receiving portions and second receiving portions containing only the first partial receiving portion 106 for the first ammunition cartridge and the second receiving portion containing only the second partial receiving portion 109 for the second ammunition cartridge. However the use of two or more arms (105, 107) provides rigidity and improves retention of the ammunition cartridge in the receiving portion Turning to FIG. 1*b* shows the same arrangement as 1*a*, from a front view, and shows the first and second receiving portions (102, 103) are offset from each other by distances (X) and (Y). In this arrangement the offset is provided by the spacer 104.

The maximum offset between the first arm and second arm, i.e. the difference between distance (X) and (Y) is 2 mm. In the present arrangement, the offset between (X) is narrower than (Y) although it may be appreciated that the offset (X) may be larger than (Y) in alternative arrangements.

Turning to FIG. 2, there is provided a wire ammunition belt link 200 comprising, a continuous sprung wire 201, said sprung wire arranged to form, a first receiving portion 202 suitable for retaining a first ammunition cartridge 208, a second receiving portion 203 suitable for retaining a second ammunition cartridge 209 and, a spacer 204 between said first receiving and second receiving portions.

In the present arrangement, the sprung wire is made from a unitary piece of sprung wire formed into said belt link.

The first and second receiving portions retain the first and second ammunition cartridge 208, 209 by way of a 'push fit' engagement such that there is interference between the cartridge case and the sprung wire 201 that forms, the first and second circular receiving portion 202, 203 are circular in nature extending 280 degrees around the ammunition cartridge.

In the present arrangement, the first and second receiving portions are offset from each other. The first arm and second arm of the first and second receiving portions are joined by a linkage 205 at the ends of the first and second arms such that it is a continuous unitary sprung wire, said linkage is made of the same continuous piece of wire as the first and second arm.

The provision of a spacer 204, allows separation between the centre points of the first ammunition cartridge and second ammunition cartridge, denoted by length X (FIG. 1*b*), when fitted within the ammunition belt link, to allow the correct spacing and hence engagement with the loading system of a belt fed ammunition system. In the present arrangement, the spacer 204 is formed from a unitary piece of wire the same as that of the first and second retaining portion in the shape of a coil such that the sprung wire has been rotated through at least 360 degrees.

In the present arrangement, there are provided two flanges 210. Said flanges are positioned length ways along the axial length of the ammunition cartridge. In the present arrangement, one of the flanges comprises an ammunition cartridge locator aide 206, said aid locates in the ejector groove 207 of a received first ammunition cartridge 208 to enable the wire ammunition belt link to be accurately located axially along the ammunition cartridge such that when joined in a link, the cartridges align.

Turning to FIGS. 3*a* & 3*b*, there is provided a wire ammunition belt 300 suitable for a belt fed ammunition system, the wire ammunition belt comprising, a first wire ammunition belt link 301 and a second wire ammunition belt link 302, wherein a first ammunition cartridge 303 is located in a first receiving portion 304 and a second ammunition cartridge 305 is located in a second receiving portion 306 of the first wire ammunition belt link, and, the second ammunition cartridge is further co-located in a first receiving portion 307 of the second wire ammunition belt link to create a continuous wire ammunition belt.

Although a few preferred arrangements have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing arrangement(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A wire ammunition belt link comprising:

a unitary continuous piece of sprung wire, said unitary continuous piece of sprung wire arranged to form a first receiving portion having a re-entrant loop of wire suitable for retaining a first ammunition cartridge, a second receiving portion having a re-entrant loop of wire suitable for retaining a second ammunition cartridge, a spacer between said first and second receiving portions, a first flange at an end of a first arm of the second receiving portion and arranged lengthwise along the axis of the retained second ammunition cartridge, a second flange at an end of a second arm of the second receiving portion and arranged lengthwise along the axis of the retained second ammunition cartridge, and an ammunition cartridge locator aide at an end of the first flange and configured to locate in an ejector groove of the retained second ammunition cartridge.

2. The wire ammunition belt link of claim 1, wherein the unitary continuous piece of sprung wire is made from sprung mild steel.

3. The wire ammunition belt link of claim 1, wherein the wire ammunition belt link is a 'push through' cartridge feed design.

4. The wire ammunition belt link of claim 1, wherein the unitary continuous piece of sprung wire is the range of from 0.25 mm to 1 mm in diameter.

5. The wire ammunition belt link of claim 1, wherein the first and second receiving portions are each a circular re-entrant loop of wire.

6. The wire ammunition belt link of claim 5, wherein the first and second receiving portions each have a diameter that is in the range of from 4% to 5% smaller than a diameter of the first ammunition cartridge and the second ammunition cartridge, respectively.

7. The wire ammunition belt link of claim 1, comprising first and second ammunition cartridges located in the respective first and second receiving portions, wherein respective centre points of the first and second ammunition cartridges are spaced apart by the spacer, so as to allow for engagement with a belt fed ammunition system.

8. The wire ammunition belt link of claim 1, wherein the unitary continuous piece of sprung wire is coated by a protective layer.

9. The wire ammunition belt link of claim 1, wherein:

the first and second receiving portions each comprise the first arm and the second arm, each of the first arm and the second arm comprising a first partial receiving portion for the first cartridge and a second partial receiving portion for the second cartridge; and the first arm and second arm are joined by a linkage, and the respective first and second partial receiving portions are joined by the spacer.

10. The wire ammunition belt link of claim 9, wherein the first and second arms are offset from each other.

11. A wire ammunition belt suitable for a belt fed ammunition system, the wire ammunition belt comprising:

first and second wire ammunition belt links according to claim 1;

wherein the first ammunition cartridge is located in the first receiving portion of the first wire ammunition belt link and the second ammunition cartridge is located in the second receiving portion of the first wire ammunition belt link; and wherein the second ammunition cartridge is further located in the first receiving portion of the second wire ammunition belt link.

12. The wire ammunition belt of claim 11, wherein the unitary continuous pieces of sprung wires of the first and second wire ammunition belt links are made from sprung mild steel.

13. The wire ammunition belt of claim 11, wherein the unitary continuous pieces of sprung wires of the first and second wire ammunition belt links are coated by a protective layer.

14. The wire ammunition belt of claim 11, wherein for each of the first and second wire ammunition belt links:

the respective first and second receiving portions each comprise the first arm and the second arm, each of the first arm and the second arm comprising a first partial receiving portion for the first cartridge and a second partial receiving portion for the second cartridge; and the respective first arm and second arm are joined by a linkage, and the respective first and second partial receiving portions are joined by the spacer.

15. The wire ammunition belt of claim 14, wherein for each of the first and second wire ammunition belt links, the first and second arms are offset from each other.

16. The wire ammunition belt of claim 11, wherein the first and second receiving portions of the first wire ammunition belt link are each a polygonal re-entrant loop of wire.

17. The wire ammunition belt link of claim 11, wherein the first and second flanges of each of the first and second wire ammunition belt links are colinearly aligned.

18. The wire ammunition belt link of claim 1, wherein the first and second receiving portions are each a polygonal re-entrant loop of wire.

19. The wire ammunition belt link of claim 1, wherein the first and second flanges are colinearly aligned.

20. A method of manufacturing a wire ammunition belt link, the method comprising bending a unitary continuous length of sprung wire by a wire forming machine to form a first receiving portion having a re-entrant loop of wire suitable for retaining a first ammunition cartridge, a second receiving portion having a re-entrant loop of wire suitable for retaining a second ammunition cartridge, a spacer between said first and second receiving portions, a first flange at an end of a first arm of the second receiving portion and arranged lengthwise along the axis of the retained second ammunition cartridge, a second flange at an end of a second arm of the second receiving portion and arranged lengthwise along the axis of the retained second ammunition cartridge, and an ammunition cartridge locator aide at an end of the first flange and configured to locate in an ejector groove of the retained second ammunition cartridge.

* * * * *